United States Patent [19]

Smulders

[11] 4,023,066

[45] May 10, 1977

[54] OPERATING CIRCUIT FOR A GAS AND/OR VAPOUR DISCHARGE LAMP

[75] Inventor: Herman Adrianus Goderfridus Severinus Smulders, Eindhoven, Netherlands

[73] Assignee: U.S. Philips Corporation, New York, N.Y.

[22] Filed: Nov. 4, 1975

[21] Appl. No.: 628,593

Related U.S. Application Data

[63] Continuation of Ser. No. 467,386, May 6, 1974, abandoned.

[30] Foreign Application Priority Data

May 21, 1973 Netherlands ..... 73/07039

[52] U.S. Cl. ..... 315/209 R; 315/105; 315/205; 315/246; 315/DIG. 4; 315/DIG. 7

[51] Int. Cl.[2] ..... H05B 41/23; H05B 41/38

[58] Field of Search ..... 315/101, 105, 200 R, 315/205, DIG. 2, DIG. 5, DIG. 4, 209 R, 246, DIG. 7

[56] References Cited

UNITED STATES PATENTS

| | | | |
|---|---|---|---|
| 3,659,150 | 4/1972 | Laupman | 315/DIG. 2 |
| 3,699,385 | 10/1972 | Paget | 315/DIG. 5 |
| 3,875,459 | 4/1975 | Remery et al. | 315/205 |
| 3,924,155 | 12/1975 | Vogeli | 315/101 X |

*Primary Examiner*—Eugene R. LaRoche
*Attorney, Agent, or Firm*—Frank R. Trifari; Bernard Franzblau

[57] ABSTRACT

An improved method of and apparatus for operating an electric discharge lamp which includes a controlled semiconductor switch connected in shunt with the lamp. By means of the semiconductor switch, the discharge lamp receives, when in operation, a plurality of voltage peaks, during every second half cycle of the AC supply voltage.

8 Claims, 2 Drawing Figures

OPERATING CIRCUIT FOR A GAS AND/OR VAPOUR DISCHARGE LAMP

This is a continuation, of application Ser. No. 467,386, filed May 6, 1974, now abandoned.

The invention relates to an arrangement provided with a gas and/or vapour discharge lamp, which arrangement is intended for supplying said lamp from an alternating voltage source in which two input terminals of the arrangement are connected by a series arrangement of at least a stabilizing inductor and the lamp and in which the lamp is shunted by a circuit comprising a controlled semiconductor switch. In the operating condition of the lamp the semi-conductor switch is rendered conducting through a control circuit at least every second half cycle of the alternating voltage source.

"Every second half cycle" means: every odd half cycle or every even half cycle.

A known arrangement of the above-mentioned type is described, for example, in U.S. Pat. No. 3,310,687. A drawback of this known arrangement is that the semiconductor switch is a "triac". In triacs as in thyristors, the non-conducting state of the semiconductor switching element can only be achieved when the current flowing therethrough drops below a low hold current value. In circuits for discharge lamps in which a stabilizing inductor is arranged in series with the lamp, a voltage peak cannot be generated in a simple manner with the combination of this inductor and the aforesaid kinds of triac. To achieve this end more circuit elements are required. This is because the instant at which the switch becomes non-conducting (substantially at the zero crossing of the current) is very unsuitable to realize a voltage peak.

An object of the invention is to realize voltage peaks across the lamp in an arrangement of the kind described in the preamble in a simple manner when the semiconductor switching element becomes non-conducting. Such voltage peaks have the advantage that re-ignition of the lamp, during further half cycles of the supply, can easily take place. A further advantage may be that the operating voltage of the lamp may be chosen to be so high that the ratio between the effective value of the supply voltage and said operating voltage may be in the order of 1.5. Another possibility is that if, for example, by switching on some other users in the vicinity, the available supply voltage suddenly becomes lower, that voltage peaks then can still be produced across the lamp sufficient to maintain a small ionisation current in the lamp. In case of recovery of the supply voltage the lamp is then immediately ignited again.

According to the invention an arrangement provided with a gas and/or vapour discharge lamp, which arrangement is intended for supply of said lamp from an alternating voltage source in which two input terminals of the arrangement are connected by a series arrangement of at least a stabilizing inductor and the lamp and in which the lamp is shunted by a circuit comprising a controlled semiconductor switch and in which in the operating condition of the lamp the semiconductor switch is rendered conducting through a control circuit at least every second half cycle (every odd half cycle or every even half cycle) of the alternating voltage source is characterized in that the controlled semiconductor switch can be switched off with the aid of a control voltage on a control electrode of said switch and that the control circuit of said semiconductor switch includes a branch having such a short time constant that the switch becomes conducting and non-conducting at least several times during each of the said half cycles of the alternating voltage source.

An advantage of such an arrangement according to the invention is that every time the semiconductor switch becomes non-conducting a voltage peak is generated with the aid of the stabilizing inductor, which peak enhances the achievement of a quick reignition of the lamp.

The semiconductor switch may be, for example, a silicon controlled switch (S.C.S.). It is likewise feasible that the semiconductor switch is another switching element, for example, a transistor.

It is feasible that in the circuit shunting the lamp two transistors are present which are arranged anti-parallel. One transistor is then used during the odd half cycles of the supply AC Voltage and the other transistor is used for the even half cycles. These transistors may then be each equipped with their own control circuit. These control circuits then include, for example, diodes whose pass directions correspond to those of the relevant transistors.

In a preferred embodiment of an arrangement according to the invention in which the semiconductor switch is a transistor, the circuit shunting the lamp includes a rectifier bridge in which the main electrodes of the transistor are incorporated in the central branch of this rectifier bridge.

An advantage of this preferred embodiment is that only one controlled semiconductor rectifier, namely one transistor, is required. An advantage is that the conducting and non-conducting state during the odd half cycles hardly deviate from those during the even half cycles of the supply voltage. This would - with the arrangement using two transistors - only be possible if these transistors had been selected for corresponding properties.

In a further preferred embodiment according to the invention the control circuit of the transistor consists of a series arrangement of a first resistor and a capacitor in combination with a breakdown element and a second resistor. The series arrangement of the first resistor and the capacitor shunts the transistor and the base of the transistor is connected through the breakdown element to the connection of the first resistor and the capacitor, while the second resistor connects the base and a main electrode of the transistor together.

An advantage of this preferred embodiment is that it leads to a very simple control circuit.

The discharge lamp may be, for example, a low-pressure mercury vapour discharge lamp. By generating voltage peaks during the operating condition of the lamp the operating voltage of this lamp may be chosen to be so high that the ratio between the effective value of the supply voltage (alternating voltage source) and said operating voltage may be less than 1.7, namely in the order of 1.5. An advantage thereof is that either the wattage of the lamp may be relatively high or a given lamp may also be operated on a supply of relatively low voltage.

It is to be noted that it is known to choose the operating voltage of a discharge lamp to be relatively high, that is to say, only slightly lower than the voltage of the AC supply voltage by using a second supply source having a higher frequency. To this end see, for example, published United Kingdom Pat. Specification No. 1,092,199. A drawback of this known arrangement is, however, that actually a second voltage source is required. In an arrangement according to the invention, however, the high-frequency voltage is generated by means of rapidly successive short-lasting short circuits of the lamp. A second voltage source is then not necessary.

In a further preferred embodiment according to the invention, in which the lamp is a low-pressure sodium vapour discharge lamp, the stabilizing inductor consists of a choke.

An advantage of this preferred embodiment is that the ballast of this lamp is very simple. In known low-pressure sodium vapour discharge lamps the ballast is generally formed as a leakage transformer. This has been done, inter alia, to make available the required relatively high voltage for re-ignition of the lamp during each half cycle of the AC supply. In the said preferred embodiment these re-ignitions are effected with the aid of the voltage peaks realized by the semiconductor switch in combination with the choke. The ballast is then simple.

It will be evident from the foregoing that with the aid of the invention the operating voltage of a discharge lamp may be chosen to be higher on the one hand, which means that for the same AC supply voltage a discharge tube of higher wattage could be made, while on the other hand the stabilizing ballast might be simpler and hence cheaper.

In a further preferred embodiment according to the invention in which the lamp is a high-pressure discharge lamp the arrangement is also provided with a thyristorstarter for the first ignition of the lamp.

An advantage of this preferred embodiment is that a reliable first ignition of the lamp can be accompanied by a reduced sensitivity to sudden AC supply voltage decreases in the operating condition of the arrangement. When a sudden AC supply voltage decrease occurs, for example, when switching on several other users, the lamp will not completely extinguish, but will remain operating at the voltage peaks generated with the aid of the semiconductor switch. This has the advantage that after the occurrence of the short-lasting AC supply voltage decrease it is not necessary to wait until an extinguished lamp has cooled down before its reignition.

The invention will be described in greater detail with reference to the accompanying drawing in which.

Figure 1:
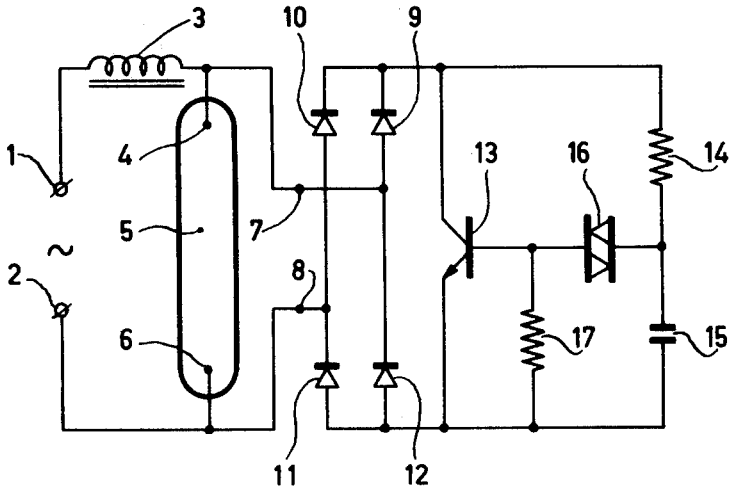
FIG. 1 shows an electrical circuit of a first arrangement according to the invention.

In FIG. 1, connection terminals 1 and 2 are intended to be connected to an alternating voltage supply of, for example, 220 Volt, 50 Hz. The terminal 1 is connected through an inductor 3 formed as a choke to an electrode 4 of a discharge lamp 5. The lamp 5 is a low-pressure sodium vapour discharge lamp. Details of this lamp such as, for example, an outer envelope encompassing the discharge tube are not shown in the Figure. The input terminal 2 is connected to an electrode 6 of the lamp 5. The electrode 4 of the lamp 5 is connected to an input terminal 7 of a diode bridge. Diodes 9 to 12 form part of this bridge. The electrode 6 of the lamp 5 is connected to an input terminal 8 of the said diode bridge. The central branch of the diode bridge 9 to 12 incorporates a transistor 13. This transistor is of the npn-type. The transistor is provided with a control circuit. This circuit consists of an input circuit constituted by a series arrangement of a resistor 14 and a capacitor 15, which series arrangement shunts the transistor 13. The base of the transistor 13 is connected through a diac 16 to a junction between the resistor 14 and the capacitor 15. In addition the base of the transistor is connected through a resistor 17 to the emitter of the transistor 13.

The operation of the described circuit is as follows. When the terminals 1 and 2 are connected to the alternating voltage source, the capacitor 15 is charged through the circuit 1, 3, 9, 14, 15, 11, 8, 2 and 2, 8, 10, 14, 15, 12, 7, 3, 1 until the breakdown voltage of the diac 16 is reached. If this breakdown voltage is reached the voltage at the base of the transistor 13 becomes so high that the transistor 13 become conducting. Subsequently a relatively high current flows through this transistor. The capacitor 15 is then discharged, inter alia, partly across resistor 17. As a result the diac 16 shortly thereafter resumes its non-conducting state. The transistor 13 is then also cut off. By cutting off the transistor 13 a voltage peak is generated with the aid of the inductor 3, which peak will be present between the electrodes 4 and 6 of the lamp 5. The control circuit of the transistor 13 is proportioned in such a manner that said voltage peaks occur a number of times per half cycle of the supply voltage. The lamp 5 then ignites. In the operating condition of the lamp the transistor auxiliary arrangement 7 to 17 remains operative because the control circuit 14 to 17 of the transistor also remains operative at the operating voltage of the lamp 5. Thus voltage peaks are continuously generated between the electrodes of the lamp 5. These peaks ensure that the lamp reignites early in a half cycle of the voltage. In a known arrangement the inductor is formed as a leakage transformer. The choke 3 in the embodiment shown is much cheaper.

In one embodiment of the circuit of FIG. 1 the wattage of the lamp 5 was approximately 55 watts and the operating voltage of this lamp was approximately 107 Volt. The resistors 14 and 17 had values of 18 k. Ohm and 100 Ohm, respectively. The capacitance of capacitor 15 was approximately 4.7 nF. The threshold voltage of the diac 16 was approximately 35 volt. In this case the frequency of the voltage peaks generated with the aid of the transistor 13 was approximately 15 to 20 kHz. The height of these peaks was approximately 800 Volt during starting of the lamp. In the operating condition of the lamp the height of the voltage peaks was also determined by the extent to which the contents of the discharge tube of the lamp were ionized at that instant. This also meant that right after a zero crossing of the lamp current, the voltage peak then occurring was relatively high, but generally lower than the said 800 Volt. The lamp then reignited easily at this relatively high voltage peak.

Figure 2:
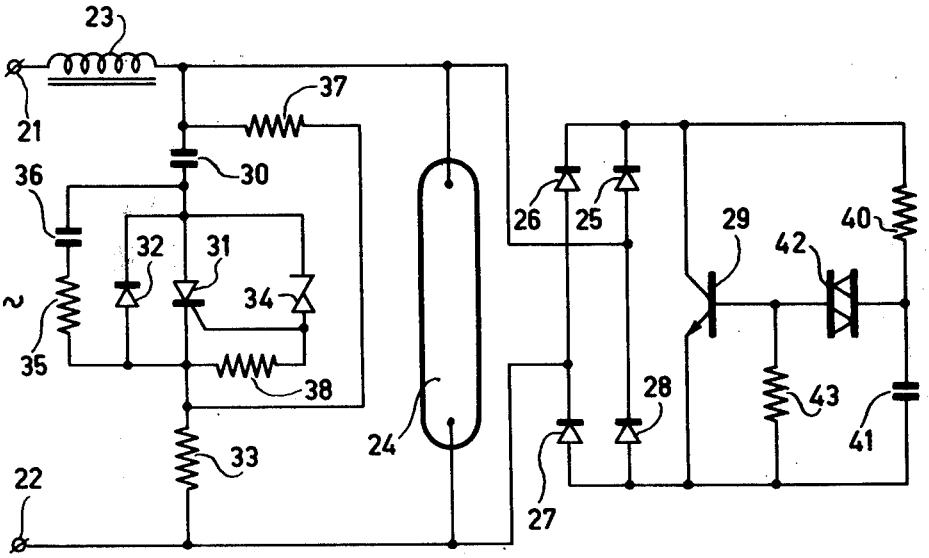
FIG. 2 shows an electrical circuit of a second arrangement according to the invention.

In FIG. 2, connection terminals 21 and 22 are again intended for connection to an alternating voltage source of, for example, 220 Volt, 50 Hz. The terminal 21 is connected to a stabilizing inductor 23. The other side of this inductor is connected to a discharge lamp 24. This is a high-pressure mercury vapour discharge lamp of approximately 400 Watts having an operating voltage of approximately 135 Volts. The input terminal 22 is connected to another electrode of the lamp 24. A starter (thyristor-starter) for the lamp 24 is connected to the connection between the inductor 23 and the lamp 24. Another input terminal of this starter is connected to the connection of the lamp 24 and the terminal 22. Furthermore the lamp 24 is shunted by a second auxiliary circuit comprising a diode bridge 25 to 28, inter alia, a transistor 29.

The starter includes a series arrangement of a capacitor 30, a thyristor 31 and a diode 32 connected antiparallel thereto, and a resistor 33. A Zener diode 34 is arranged between the control electrode and the anode of the thyristor 31. Furthermore the diode 32 is shunted by a series arrangement of a resistor 35 and a capacitor 36. The combination of the diode 32 and the capacitor 30 is also shunted by a resistor 37.

In the further auxiliary arrangement, which includes the transistor 29, a control circuit of this transistor is also present. This control circuit consists, inter alia, of a series arrangement of a resistor 40 and a capacitor 41. The series arrangement 40, 41 shunts the transistor 29. The base of the transistor 29, which is of the npn type, is connected through a diac 42 to a junction between the resistor 40 and the capacitor 41. In addition the base of the transistor 29 is connected to the emitter of this transistor through a resistor 43. This control circuit of the transistor 29 is substantially the same as that for the transistor 13 in FIG. 1, also as regards proportioning of the circuit elements. The circuit section constituted by the terminals 21 and 22 and the inductor 23 and the lamp 24, as well as the circuit elements 30 and 37, are known from U.S. Pat. No. 3,679,936. The novel aspect in the circuit of FIG. 2 is the addition of the section constituted by the auxiliary arrangement with the elements 25 to 29 and 40 to 43.

The operation of the described circuit is as follows. Initially the influence of the circuit elements 35 to 38 is left out of consideration. When the terminals 21 and 22 are connected to the alternating voltage source, the capacitor 30 will be charged through the resistor 33 and the diode 32 during the first half cycle in which the terminal 22 is positive relative to the terminal 21. During the next half cycle in which the terminal 21 is positive relative to the terminal 22, the capacitor 30 will initially not be discharged. This is effected when the instantaneous value of the supply voltage has become so high that together with the voltage across the capacitor the threshold voltage of the Zener diode 34 has been reached. Then the thyristor 31 will be rendered conducting. The capacitor 30 will then be discharged and subsequently charged to a negative value. Subsequently the thyristor 31 will become non-conducting (because its current becomes zero) and the capacitor 30 will be charged again through the diode 32. This process might be repeated one or more times during the same half cycle. This is dependent, inter alia, on the choice of the threshold voltage of the Zener diode 34 and on the value of the other circuit elements such as the resistor 33. The capacitor charges and discharges obtained in the manner described produce high voltage peaks across the series arrangement 33, 31/32, 30, which peaks will be present across the electrodes of the discharge lamp 24. The lamp 24 is then ignited. However, if the lamp is not immediately ignited, one or more voltage peaks are generated again during a subsequent half cycle of the AC supply. When the lamp 24 is ignited as a result of the generated voltage peaks, the discharge is maintained by the available supply voltage. After ignition of the lamp 24 the voltage across the bridge 30, 31, 32, 33 decreases to the operating voltage of the lamp. The Zener diode 34 is proportioned in such a manner that at this operating voltage the control electrode of the thyristor 31 no longer receives any control pulses. The impedance 23 then serves for stabilizing the discharge in the lamp 24. The resistor 33 serves for limiting the current through the thyristor 31 during the ignition process. The resistor 38 functions to prevent the thyristor 31 from becoming conducting as a result of the voltage pulses during the operating condition of the lamp 24. The series arrangement of the capacitor 36 and the resistor 35 serves to maintain the thyristor 31 non-conducting when rapid voltage variation might occur during the operating condition of the lamp 24. The resistor 37 serves to discharge the capacitors 30 and 36 in the case where the starter (30 to 37) is removed from the holders.

During the ignition process of the lamp 24 the auxiliary arrangement including the transistor 29 also becomes operative. In a corresponding manner as in the circuit of FIG. 1, the transistor 29 then becomes conducting for a short time at a rapid rate and is then rendered non-conducting again. The auxiliary arrangement 25 to 29 and 40 to 43 has, however, hardly any influence on the ignition process of the lamp 24. This auxiliary arrangement is mainly important for the situation which is obtained after the lamp 24 is ignited. The control circuit 40 to 43 of the transistor 29 is proportioned in such a manner that it also remains active at the operating voltage of the lamp 24.

All this leads to the fact that in the normal operating condition of the lamp 24 high voltage peaks are always generated across the lamp 24 by the combination of the inductor 23 and the transistor 29.

These peaks are particularly important if for some reason or other, the voltage between the terminals 21 and 22 decreases below the normal value. If that happened, there would be the risk that the lamp extinguishes, especially if the supply voltage decreases to a value below the operating voltage of the lamp. The auxiliary arrangement 25 to 29 and 40 to 43 will then, however, remain active for a still longer time, that is to say, also during these large supply voltage decreases, so that voltage peaks are still maintained across the lamp 24 and hence small currents continue to flow through the lamp. As a result a certain ionisation will be maintained in the internal part of the discharge tube of this lamp. If then a short-lasting supply voltage decrease is over, the lamp reignites immediately and exhibits the original lumen value. The addition of the auxiliary arrangement 25 to 29 and 40 to 43 is thus mainly important in the circuit of FIG. 2 to obviate detrimental influences of short-lasting supply voltage decreases as much as possible. Furthermore the voltage peaks generated with the aid of this auxiliary arrangement enhance the quick reignition of the lamp 24 during each half cycle of the alternating voltage supply in the normal operating condition of the lamp of FIG. 2.

In the arrangements of FIG. 1 and 2 the total time of a transistor being conductive during a half cycle of the supply voltage was only approximately 1% of the total duration of this half cycle. This meant that the lamps 5 and 24 were short-circuited for approximately 1% of the duration. This therefore had hardly any influence on the lumen value of these lamps.

It is, however, feasible that, for example, the resistor 14 in FIG. 1 or the resistor 40 in FIG. 2 be replaced by a variable resistor so that the conduction time of the transistors 13 and 29 can be made relatively longer. It is then achieved that in these arrangements dimming of the lamps 5 and 24 also becomes possible.

If desired the resistor 40 may be replaced by a resistor having a negative temperature coefficient (NTC Resistor). This may be done, for example, to cause the transistor auxiliary arrangement to become active in a delayed manner only after the first ignition of the lamp 24 by the thyristor starter. The risk of influence on the operation of the thyristor starter by the transistor auxiliary arrangement can then be further reduced.

The combination of the diode bridge, the transistor and the control circuit of the transistor can be accommodated in a relatively small space which, as regard contents and shape, may be the same as that of a glow discharge starter for a low-pressure mercury vapour discharge lamp.

Further modifications of the control circuits of the transistors are of course feasible.

It is likewise feasible that a transistor auxiliary circuit operates two or more discharge lamps. This might be done, for example, by incorporating an isolation capacitor in a number of the connections between a lamp electrode and the transistor auxiliary circuit.

In a further embodiment (not shown) of an arrangement according to the invention, a low-pressure mercury vapour discharge lamp of 40 Watts in series with a choke was used. This series arrangement was connected to an alternating voltage source of 150 Volt, 50 Hz. The operating voltage of the lamp was approximately 103 Volt. This lamp was furthermore shunted by a transistor auxiliary circuit as denoted by the reference numerals 7 to 17 in FIG. 1.

In the embodiment described in the previous paragraph the ratio between the effective supply voltage and the operating voltage of the lamp was 155/103 = approximately 1.5.

The low-pressure mercury vapour discharge lamp of this embodiment operated in a stable manner.

What is claimed is:

1. A circuit arrangement for supplying alternating current to an operating electric discharge lamp comprising, a pair of input terminals for connecting said lamp to an alternating voltage source, means connecting a series arrangement of at least a stabilizing inductor and the lamp across said input terminals, means connecting a circuit comprising a controlled semiconductor switch in shunt with the lamp, a control circuit for triggering the semiconductor switch into conduction at least once every second half cycle of the alternating voltage source in the normal operating condition of the lamp, the control circuit being coupled to a control electrode of the controlled semiconductor switch for applying a switch-off control voltage to the control electrode of said switch, and wherein the control circuit of said semiconductor switch includes a branch having an element with a relatively short time constant such that the switch is triggered on and off at least several times during each of said second half cycles of the alternating voltage source.

2. A circuit arrangement as claimed in claim 1 wherein the discharge lamp uses cold electrodes and is chosen to have an operating voltage such that the ratio of the effective value of the voltage of the alternating voltage source to the lamp operating voltage is less than 1.7.

3. A circuit arrangement as claimed in claim 1 wherein the semiconductor switch comprises a transistor and said time constant element is chosen to trigger the transistor so that the total conduction time of the transistor during each of said second half cycles of the alternating voltage source is approximately one percent of the total time period of said half cycle.

4. A circuit arrangement as claimed in claim 3 wherein the time constant element comprises a serially connected first resistor and capacitor connected in shunt with the transistor, the control circuit further comprising a voltage breakdown element, a second resistor, and means connecting the base of the transistor to the junction between the first resistor and the capacitor via the breakdown element and the second resistor between the base and emitter of the transistor.

5. A method of operating an electric discharge lamp from an alternating current source of a given frequency, said lamp being connected to a ballast device and to a control circuit including a controlled semiconductor switch connected in shunt with the lamp and a circuit timing element having a short time constant relative to said given frequency and coupled to a control electrode of the semiconductor switch for triggering the switch on and off at a frequency higher than said given frequency, the method comprising applying an AC current from said AC source to the lamp terminals via the ballast device, generating with the aid of the control circuit a plurality of high voltage pulses during alternate half cycles of the AC source until the lamp ignites, and maintaining the supply of said high voltage pulses to the lamp terminals during the operating condition of the lamp.

6. A method as claimed in claim 5 wherein the supply of high voltage pulses is maintained during the operating condition of the lamp by triggering the semiconductor switch on and off during alternate half-cycles of the AC source at a frequency determined by said circuit timing element.

7. A method as claimed in claim 5 comprising the further step of maintaining a supply of a plurality of high voltage pulses to the lamp terminals during the opposite alternate half cycles of the AC source and with the lamp in its operating condition.

8. A method as claimed in claim 5 wherein said high voltage pulses are generated with a short time duration such that the total on time of said pulses per half cycle of the AC source is approximately one percent.

* * * * *